US005600910A

United States Patent [19]

Blackburn

[11] Patent Number: 5,600,910

[45] Date of Patent: Feb. 11, 1997

[54] MODULAR DISPLAY SYSTEM

[76] Inventor: Dennis R. Blackburn, 3501 Tiffany Dr., Indianapolis, Ind. 46226

[21] Appl. No.: 493,134

[22] Filed: Jun. 21, 1995

[51] Int. Cl.[6] ..... G09F 7/00

[52] U.S. Cl. ..... 40/605; 40/615; 273/157 R

[58] Field of Search ..... 40/605, 904, 594, 40/615; 283/34; 434/150, 153, 172; 273/157 R, 157 A

[56] References Cited

U.S. PATENT DOCUMENTS

| | | | |
|---|---|---|---|
| 964,065 | 7/1910 | Snedeker . | |
| 2,294,276 | 8/1942 | Callinicos . | |
| 2,889,638 | 6/1959 | Anderson . | |
| 2,953,380 | 9/1960 | Hassenbach | 273/157 R |
| 3,540,732 | 11/1970 | Wilson | 273/157 R |
| 4,030,218 | 6/1977 | Stockwell . | |
| 4,050,698 | 9/1977 | Brown | 273/157 R X |
| 4,673,197 | 6/1987 | Shtipelman et al. . | |
| 5,010,672 | 4/1991 | Coleman | 40/615 |
| 5,217,226 | 6/1993 | Christopher | 273/157 A X |
| 5,257,785 | 11/1993 | Sugie | 273/157 R |

*Primary Examiner*—Brian K. Green
*Attorney, Agent, or Firm*—Locke Reynolds

[57] ABSTRACT

A modular display system is disclosed for displaying a map, graph, chart or other planar graphic representation in a plurality of planar modules capable of being disposed in a planar contiguous array having a smooth, markable surface. Each module is formed of a generally rectangular planar base portion having a plurality of planar projecting tongues and planar grooves, a rectangular portion of a map, graph, chart or other planar graphic representation, and a rectangular planar transparent cover portion. The aligned attachment of a base portion, a graphic portion, and a cover portion using adhesive forms a module. By temporary interlocking planar arrangement of modules, with tongues and grooves of each base portion in mating disposition with the grooves and tongues of other base portions, a planar surface is provided with the graphic portions capable of being viewed through the cover portions.

15 Claims, 8 Drawing Sheets

MODULAR DISPLAY SYSTEM

BACKGROUND OF THE INVENTION

1. Field of the Invention

The present invention generally relates to display systems for maps, graphs, charts and similar planar graphic representations, and particularly concerns display systems of type that are formed as separable modules, each module representing a portion of the display of a map, graph, chart or other planar graphic representation.

2. Description of the Prior Art

The array of available modular display systems includes a variety of systems where a map, graph, chart or other planar graphic representation to be displayed is divided into portions or modules. For instance, the system described in U.S. Pat. No. 964,065 includes a vertically mountable display divided into interlocking modules connected by longitudinally locking pins. In addition, the portions of a map or other display may be formed as pages of a book, such as described in U.S. Pat. No. 2,889,638, or may be removably disposed within a ring binder, such as described in U.S. Pat. Nos. 4,030,218 and 4,673,197. Further, a portion of the surface of display portions may have a transparent surface that enables various markings to be drawn on and thereafter removed from the surface, so that, for instance, a route may be drawn on a map and later removed.

Despite the availability of such display systems, there exists a need in the art for a modular display system that is capable of use for conveniently drawing a route or similar on the surface of the modules disposed in a contiguous configuration, yet permits the modules to be separated and placed in a ring notebook.

SUMMARY OF THE INVENTION

In order to aid in the understanding of the present invention, it can be stated in essentially summary form that it is directed to a modular display system that is capable of displaying a map, graph, chart or other planar graphic representation in a plurality of separable planar modules capable of being disposed in a planar contiguous array having a smooth, markable surface.

Each of a plurality of generally rectangular planar base portions has a top surface, first and second longer sides, and first and second shorter sides, with a plurality of planar tongues disposed in the plane of the base portion and projecting from the first longer and shorter sides. Disposed along the second longer and shorter sides are a plurality of corresponding grooves, each tongue of a first longer side of a base portion capable of mating with a groove of the second longer side of another base portion, and each tongue of a first shorter side of a base portion capable of mating with a groove of a second shorter side of another base portion, the base portions thereby capable of being disposed in an interlocking planar array. Indicia are provided on one of the tongues of each base portion for indicating the relative position of each module with respect to the other modules.

A map, graph, chart or other planar graphic representation may be divided into a plurality of rectangular planar graphic portions, each graphic portion having a lower surface and an upper surface, with the planar dimensions of each graphic portion substantially the same as the rectangular planar dimensions of each base portion. The graphic portions may be formed of paper upon which a map, display, chart or other graphic representation has been printed, copied, or otherwise permanently affixed on an upper surface. Each graphic portion is attached to one base portion so that the top surface is adjacent to the lower surface, using an adhesive disposed between the top surfaces and the lower surfaces. In this way, aligning attachment the rectangle of each graphic portion with the rectangular portion of one of base portions, with tongues disposed to project from graphic portions, while the grooves are covered by the graphic portions.

Each of a plurality of rectangular planar cover portions has an inside surface and an outside surface, with the planar dimensions of each cover portion substantially the same as the planar dimensions of each graphic portion. The cover portions are formed of a transparent material with the outside surfaces smooth and impermeable to commonly available markers and pens. Using adhesive, aligning attachment of each cover portion to one graphic portion is made, with upper surfaces disposed adjacent to inside surfaces.

The aligned attachment of a base portion, a graphic portion, and a cover portion using adhesive forms a module of the present invention. A display is formed by interlocking planar arrangement of a number of modules, with the tongues and grooves of each base portion in mating disposition with the grooves and tongues of other base portions, and with the outside surfaces disposed as a flat surface, with the graphic portions viewable through the cover portions.

In use, a map, graph, chart or other planar graphic representation that has been divided into a number of the graphic portions, and consequently into a number of the modules, may be placed upon a table or other flat surface and interlocked to reform all or a portion of the map, graph, chart, or other planar graphic representation. The reformation of the map, graph, chart or other planar graphic representation is facilitated by the indicia, where, for instance, the column and row of each module may be set forth. With the modules disposed in this manner, markings, notes, and other information may be made upon the outside surfaces with an appropriate pen, marker or similar. Thereafter, selected modules may be separated, and placed in a more compact configuration, for instance, in a ring binder using the mounting holes, so that the modules may be conveniently consulted in a compact, orderly manner. Further, the modules may be removed from the ring binder or similar and placed once more on a flat surface, with the indicia determining the relative position of the modules. By cleaning the markings from the outside surfaces, the modules may be reused.

It is an object of the present invention to provide a modular display system that is capable of displaying a map, graph, chart or other planar graphic representation with modules disposed in a planar, contiguous mode providing a smooth surface upon which markings may be made.

It is another object of the present invention to provide a modular display system that is capable of displaying a map, graph, chart, or other planar graphic representation with modules disposed in a separated mode.

It is another object of the present invention to provide a modular display system with modules capable of use with a number of maps, graphs, charts, and other planar graphic representations.

It is another object of the present invention to provide a modular display system with modules capable removable placement within a ring binder.

It is still another object of the present invention to provide a modular display system which is inexpensive to produce, and of relatively simple construction with a minimum number of components.

Further objects and advantages of the present invention will be apparent from a study of the following portion of the specification, the claims, and the attached drawings.

DESCRIPTION OF THE PREFERRED EMBODIMENT

Figure 1:
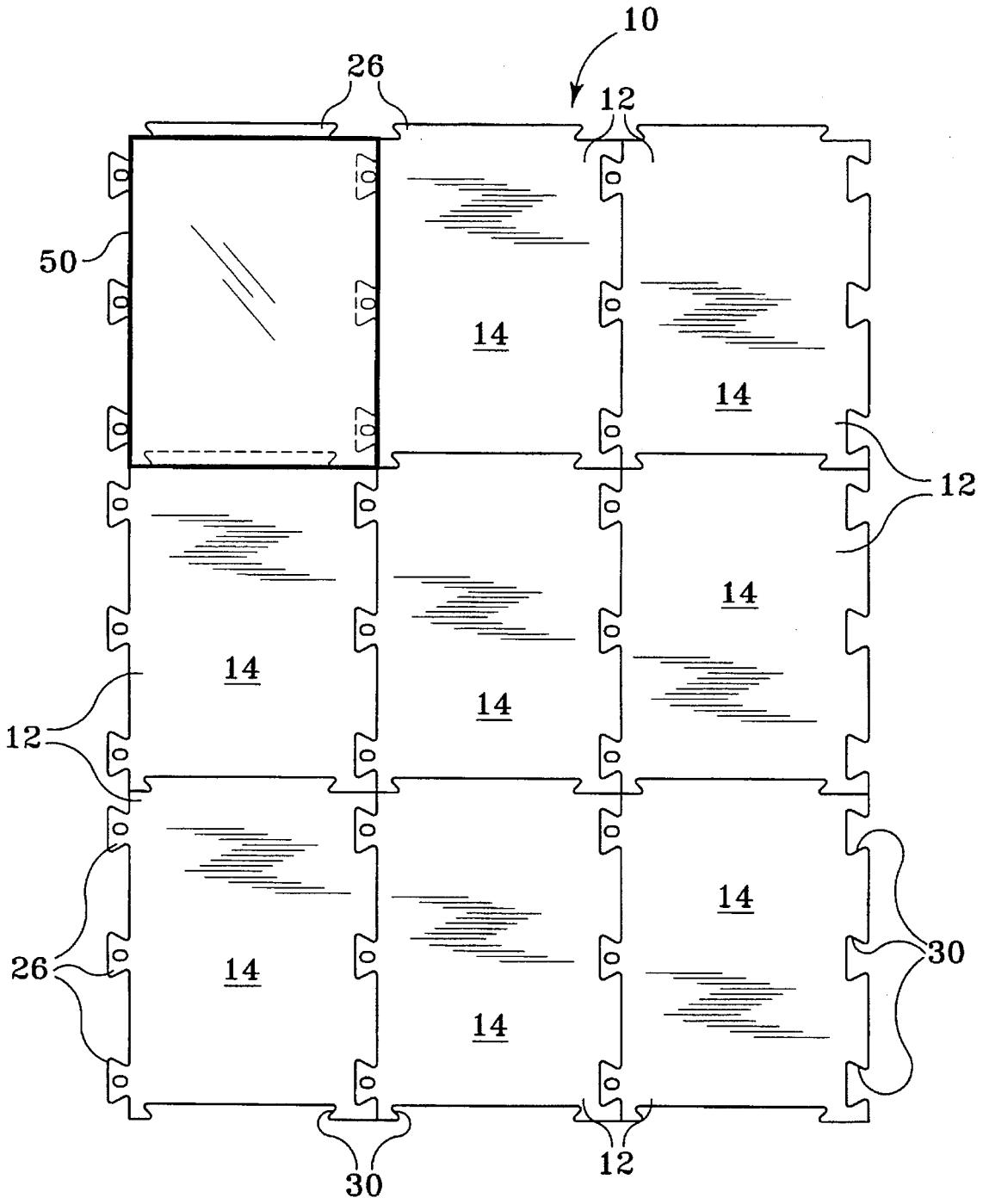
FIG. 1 is a top plan view of a plurality of base portions of a modular display system representing the present invention, with a cover portion shown in bold and the grooves of the corresponding base portion shown in phantom.

The following portion of the specification, taken in conjunction with the drawings, sets forth the preferred embodiments of the present invention. The embodiments of the invention disclosed herein are the best mode contemplated by the inventor for carrying out his invention in a commercial environment, although it should be understood that various modifications can be accomplished within the parameters of the present invention.

Referring now to the drawings for a detailed description of the present invention, reference is first made to FIGS. 1–4, depicting modular display system 10 having a plurality of identical, generally rectangular planar base portions 12, each base portion 12 having top surface 14, first and second longer sides 16 and 18, and first and second shorter sides 20 and 22. Along first longer side 16 and first shorter side 20 are a plurality of projecting tongues 26 disposed in the plane of base portion 12, with tongues 26 defining mounting holes 28. Along second longer side 18 and second shorter side 22 are a plurality of corresponding grooves 30. Each tongue 26 of first longer side 16 of one of base portions 12 is capable of mating with one of grooves 30 of second longer side 18 of another base portion 12, and each tongue 26 of first shorter side 20 of one of base portions 12 is capable of mating with one of grooves 30 of second shorter side 20 of another base portion 12. In this way, base portions 12 may be disposed in an interlocking planar array. Indicia 32 are provided on one of tongues 26 of each base portion 12, for indicating the relative position of base portions 12 in the interlocking planar array as hereinafter described, indicia 32 exposed to view when base portions 12 are not disposed in the interlocking planar array.

Figure 3:
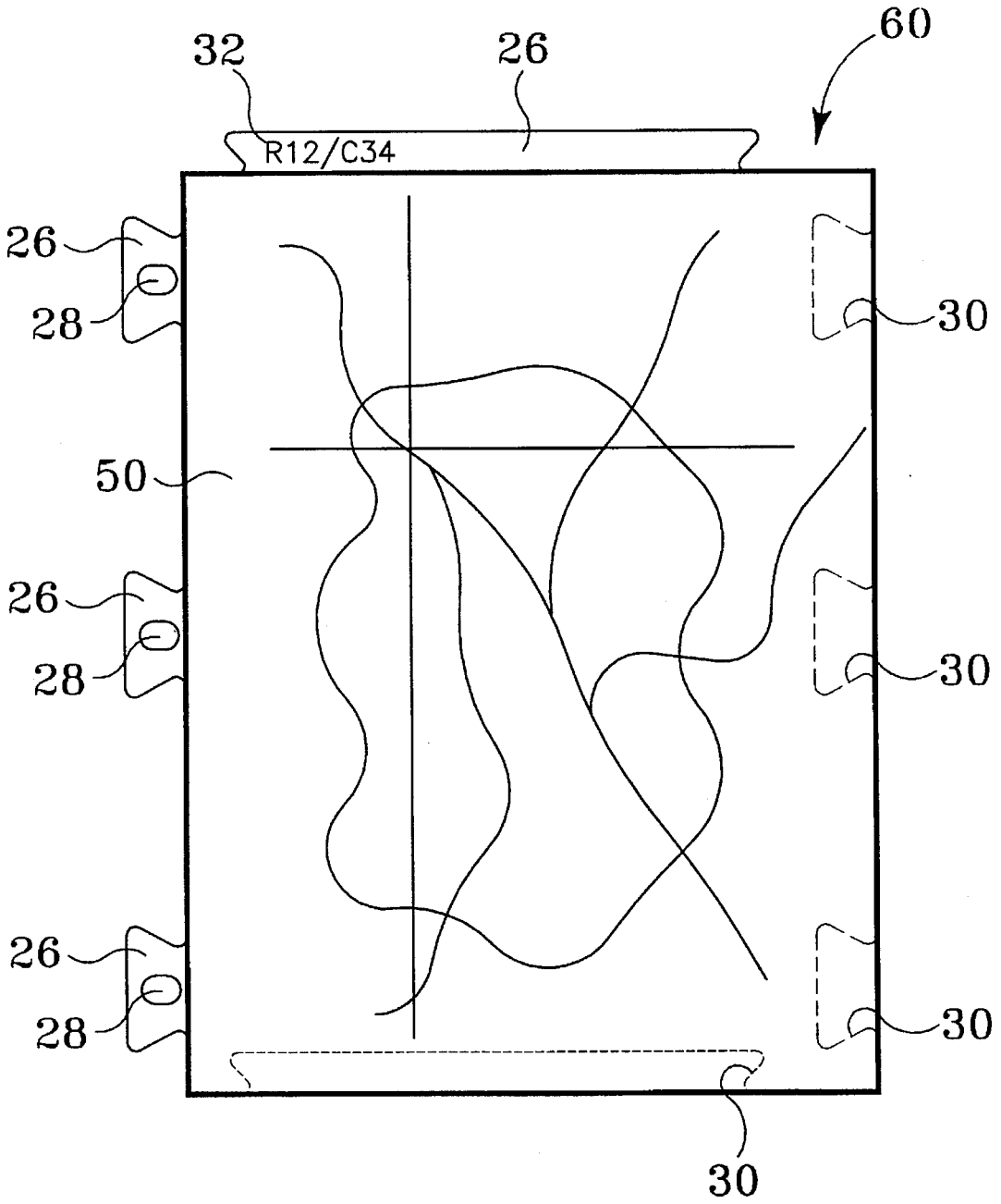
FIG. 3 is a top plan view of a module of a modular display system representing the present invention, with the grooves of the base portion shown in phantom.
Figure 4:
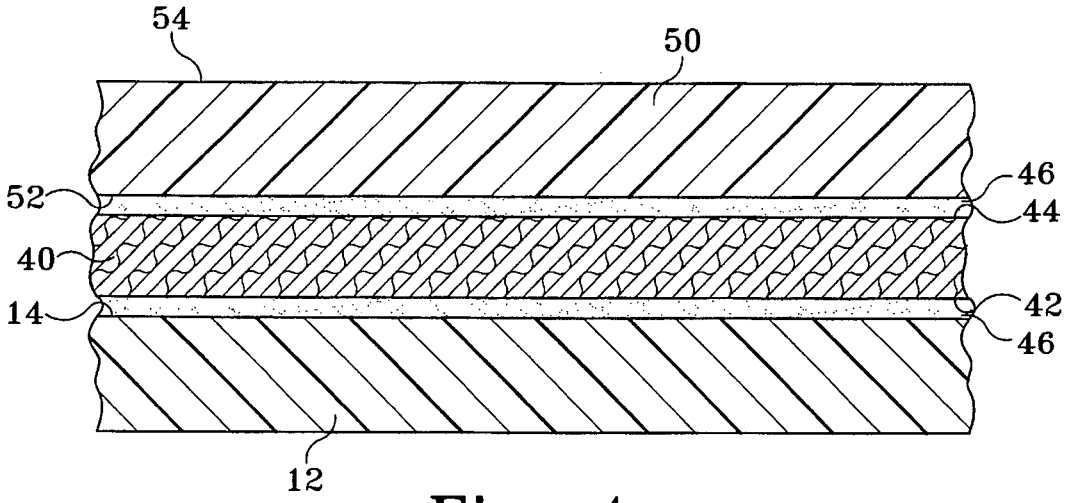
FIG. 4 is a cross-section detail view of a module of a first embodiment of a modular display system representing the present invention.

Shown in FIGS. 3 and 4 is a map, graph, chart or other planar graphic representation divided into a plurality of rectangular planar graphic portions 40, each graphic portion 40 having lower surface 42 and upper surface 44, the planar dimensions of each graphic portion 40 substantially the same as the rectangular planar dimensions of each base portion 12. As will be described, graphic portions 40 may be formed of paper upon which a map, display, chart or other graphic representation has been printed, copied, or otherwise permanently affixed at upper surface 44. Each graphic portion 40 is attached to one base portion 12 so that top surface 14 is adjacent to lower surface 42, using adhesive 46 disposed between top surfaces 14 and lower surfaces 42 for maintaining aligning attachment with the rectangle of each graphic portion 40 aligning with the rectangular portion of one of base portions 12. By attachment in this configuration, as shown in FIG. 3, tongues 26 are disposed to project from graphic portions 40, while grooves 30 are covered by graphic portions 40.

Referring to FIGS. 3 and 4, a plurality of identical rectangular planar transparent cover portions 50, each cover portion 50 having inside surface 52 and outside surface 54, with the planar dimensions of each cover portion 50 substantially the same as the planar dimensions of each graphic portion 40. Cover portions 50 may be formed of a transparent material such as plastic, having outside surfaces 54 smooth and impermeable to commonly available markers and pens. Using adhesive 46 disposed between each upper surface 44 and each inside surface 52, aligning attachment of each cover portion 50 to one graphic portion 40 is made, with upper surfaces 44 disposed adjacent to inside surfaces 52, as shown in the upper left hand corner of FIG. 1 with respect to a single cover portion 50. It will, of course, be appreciated that FIG. I is illustrative only, with only one cover portion 50 depicted, it being the case that in use, each base portion 12 of the present invention will be covered by a cover portion 50.

The aligned attachment of a base portion 12, a graphic portion 40, and a cover portion 50 using adhesive 46 forms a module 60, as shown in FIG. 3. By interlocking planar arrangement of a number of modules 60, with tongues 26 and grooves 30 of each base portion 12 in mating disposition with grooves 30 and tongues 26 of other base portions 12, outside surfaces 54 of cover portions 50 form a flat surface with graphic portions 40 capable of being viewed through cover portions 50.

Figure 2:
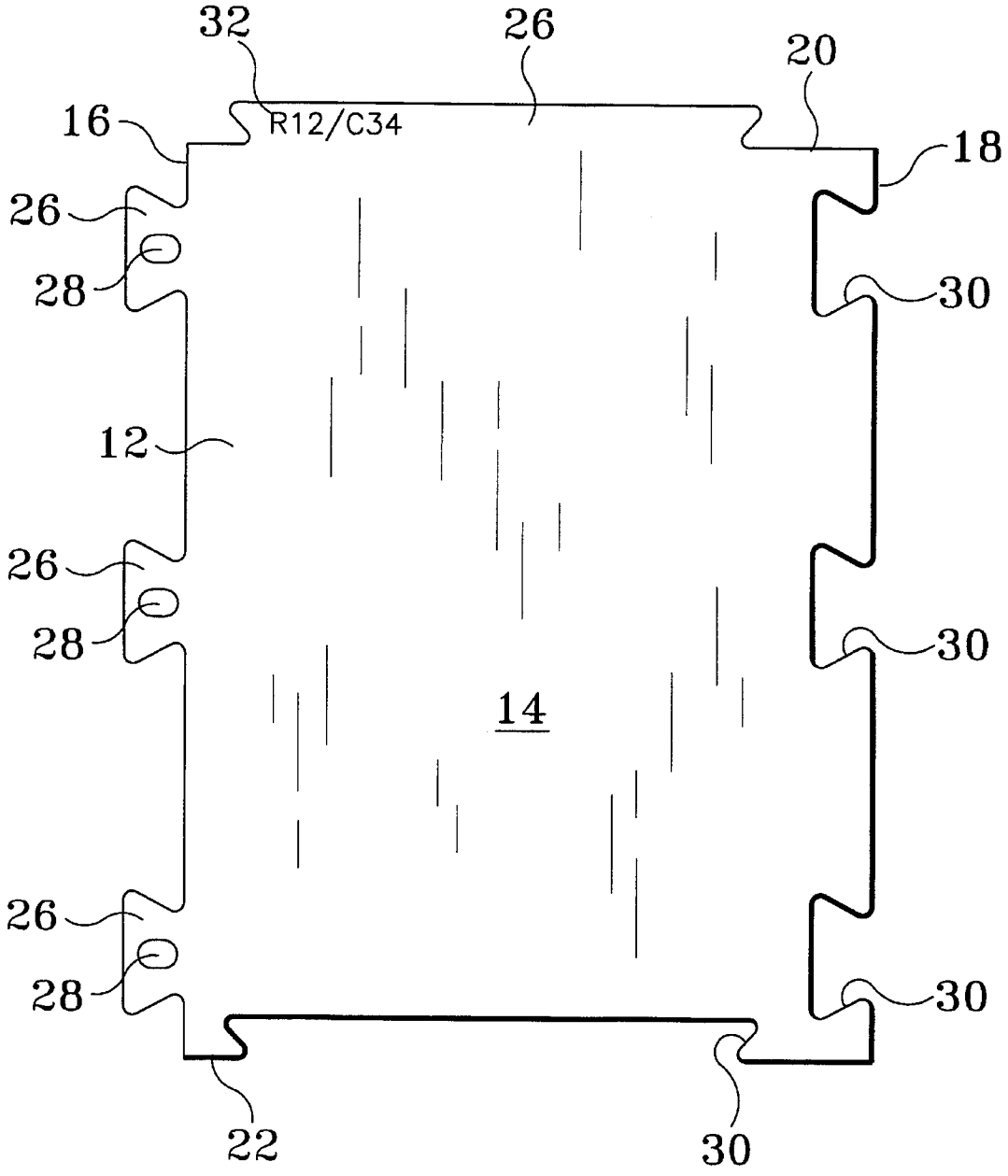
FIG. 2 is a top plan view of a base portion of a modular display system representing the present invention.

In use, a map, graph, chart or other planar graphic representation that has been divided into a number of graphic portions 40, and disposed into a number of modules 60, may be placed upon a table or other flat surface and interlocked to reform all or a portion of the map, graph, chart, or other planar graphic representation. The reformation of the map, graph, chart or other planar graphic representation is facilitated by indicia 32, where, for instance, the row and column of each module 60 may be set forth, as shown in FIGS. 2 and 3, where "R12" indicates row 12 and "C34" indicates column 34. With modules 60 disposed in this manner, markings, notes, and other information may be placed upon outside surfaces 54 with an appropriate pen, marker or similar. For instance, where graphic portions 40 are in the form of a navigational map or chart, a navigational course covering a number of modules 60 may be marked at a single time. Thereafter, selected modules 60 may be separated, and placed in a more compact configuration, for instance, in a ring binder using mounting holes 28. In this way, individual modules 60 may be conveniently consulted in a compact, orderly manner. Further, modules 60 may be removed from the ring binder or similar and placed once more on a flat surface, with indicia 32 determining the relative position of modules 60. As outside surfaces 54 are impermeable to the markings placed thereon, by cleaning the markings from outside surfaces 54, modules 60 may be reused.

In addition, it will be noted that base portions 12 may be formed from a transparent material, so that a map, display, chart or other graphic representation printed, copied, or otherwise permanently affixed at lower surfaces 42 may be viewed through base portions 12. In this way, modules 60 become usable in a double-sided manner, with modules 60 capable of being disposed in a flipped, inverted planar interlocking array.

Figure 5:
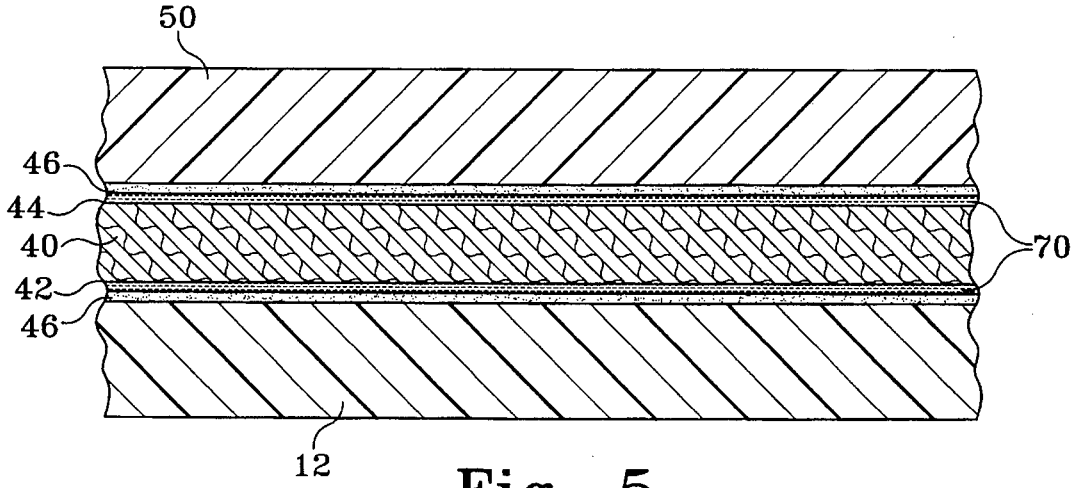
FIG. 5 is a cross-section detail view of a module of a second embodiment of a modular display system representing the present invention.

In a second embodiment as depicted in FIG. 5, lower surfaces 42 and upper surfaces 44 may each be coated with anti-stick coating 70, in order to permit graphic portions 40 to be removably attached between base portions 12 and cover portions 50. In this way, a number of different map, graphs, charts and other planar graphic representations disposed into graphic portions 40 may be used with a set of modules 60. It will be recognized that anti-stick coating 70 may tend to permeate into graphic portions 40, so that the material from which graphic portions 40 is formed may be treated to resist penetration by anti-stick coating 70.

Figure 6:
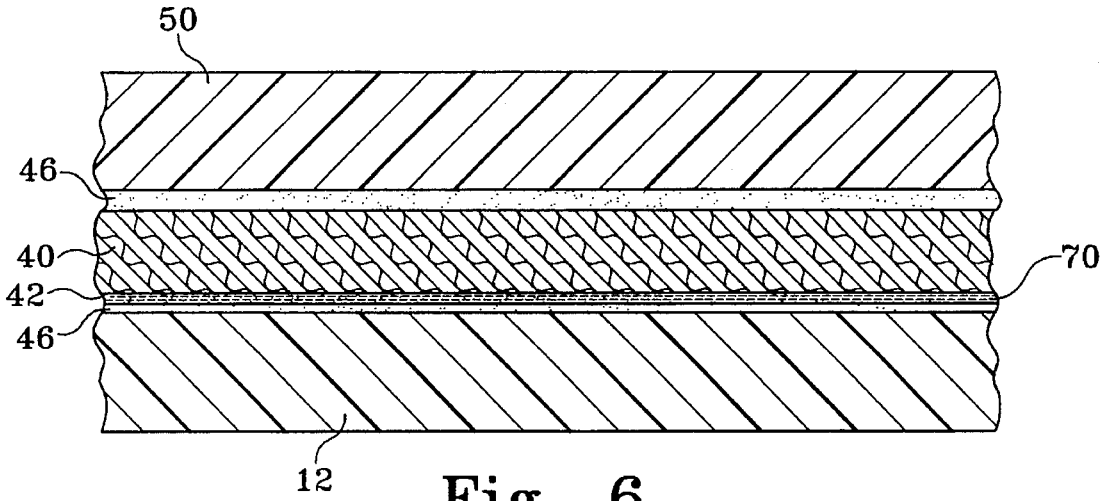
FIG. 6 is a cross-section detail view of a module of a third embodiment of a modular display system representing the present invention.

In a third embodiment as depicted in FIG. 6, lower surfaces 42 may be coated with anti-stick coating 70, in order to permit graphic portions 40 to be removably attached to base portions 12. In this way, a number of graphic portions 40 of different map, graphs, charts and other planar graphic representations may be used with a set of base portions 12. The material from which graphic portions 40 is formed may be treated to resist penetration by anti-stick coating 70 which may tend to permeate into graphic portions 40.

Figure 7:
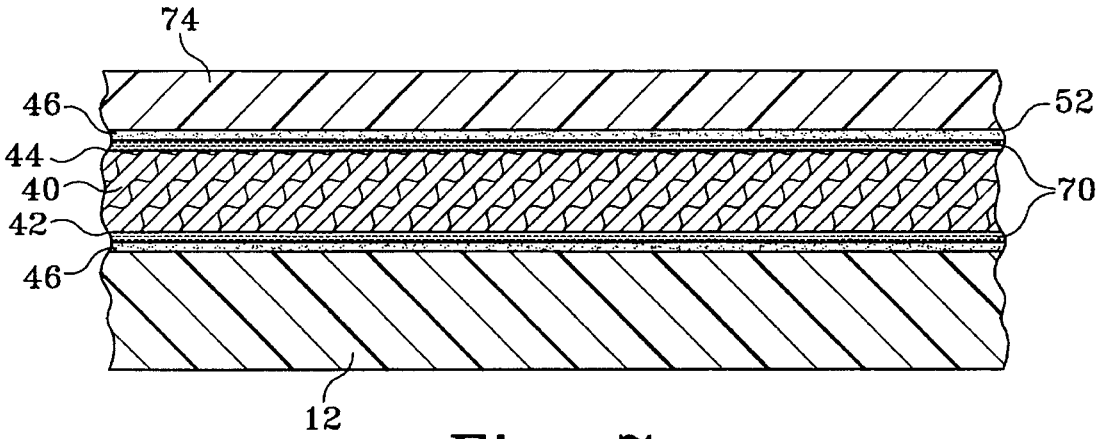
FIG. 7 is a cross-section detail view of a module of a fourth embodiment of a modular display system representing the present invention.

In a fourth embodiment as depicted in FIG. 7, relatively thin transparent plastic sheets 74 having adhesive 46 on inside surfaces 52, such as a transparent plastic self-adhesive label, may be applied to graphic portions 40, with lower surfaces 42 and upper surfaces 44 each coated with anti-stick coating 70. In this way, cover portions 50 may be removed by peeling away from graphic portions 40, and graphic portions 40 may be removed from base portions 12 so that different maps, graphs, charts and other planar graphic representations disposed onto a number of graphic portions 40 may be used with a set of base portions 12, and cover portions 50. As described above, the material from which graphic portions 40 is formed may be treated to resist penetration by anti-stick coating 70.

Figure 8:
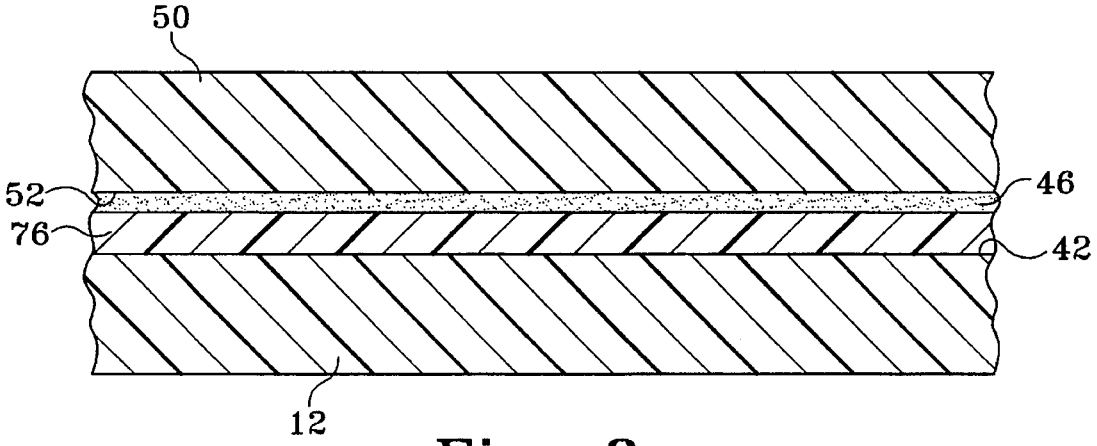
FIG. 8 is a cross-section detail view of a module of a fifth embodiment of a modular display system representing the present invention.

In a fifth embodiment as depicted in FIG. 8, inside surfaces 52 may be coated with adhesive 46, and a map, graph, chart or other planar graphic representation may be produced on plastic portions 76 having exceptionally smooth lower surfaces 42, such as the surface provided by so-called "static-cling" materials, so that plastic portions 76 may be removably attached to base portions 12 by electrostatic attraction. In this way, plastic portions 76 and cover portions 50 may be removed as a unit from base portions 12 so that different maps, graphs, charts and other planar graphic representations disposed onto a number of plastic portions 76 may be used with a set of base portions 12.

Figure 9:
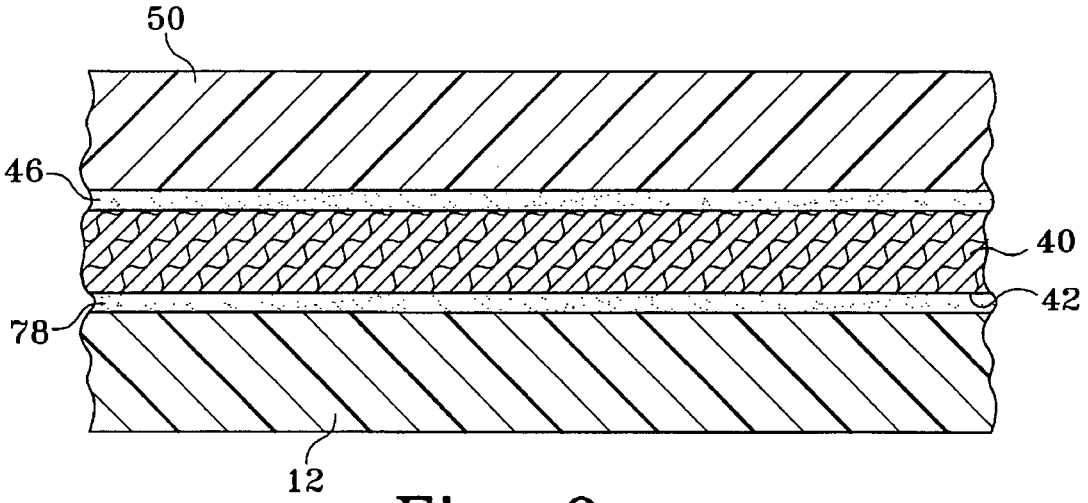
FIG. 9 is a cross-section detail view of a module of a sixth embodiment of a modular display system representing the present invention.

In a sixth embodiment as depicted in FIG. 9, semi-permanent adhesive 78 of the multiple use type similar to that used in postable notes is applied to lower surfaces 42. In this way, different map, graphs, charts and other planar graphic representations disposed onto a number of graphic portions 40 may be used with a set of base portions 12.

Figure 10:
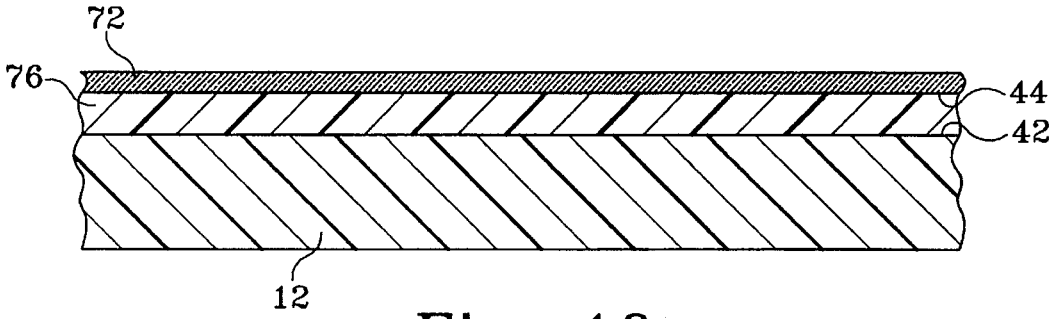
FIG. 10 is a cross-section detail view of a module of a seventh embodiment of a modular display system representing the present invention.

In a seventh embodiment as depicted in FIG. 10, a map, graph, chart or other planar graphic representation may be produced on plastic portions 76 having exceptionally smooth lower surfaces 42, such as the surface provided by so-called "static-cling" materials, and cover portions 50 may be omitted and a transparent impermeable coating such as varnish 72 may be applied to upper surfaces 44, with plastic portions 76 removably attachable to base portions 12 by electrostatic attraction. In this way, plastic portions 76 may be removed from base portions 12 so that different maps, graphs, charts and other planar graphic representations disposed onto a number of plastic portions 76 may be used with a set of base portions 12.

Figure 11:
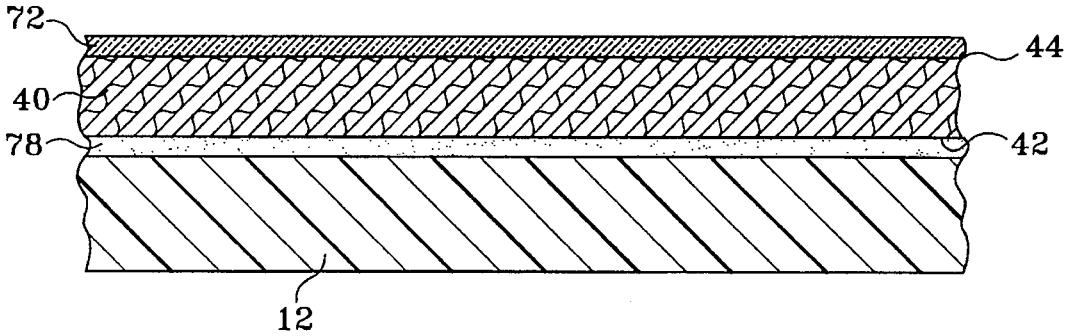
FIG. 11 is a cross-section detail view of a module of a eighth embodiment of a modular display system representing the present invention.

In an eighth embodiment as depicted in FIG. 11, cover portions 50 may be omitted and a transparent impermeable coating such as varnish 72 may be applied to upper surfaces 44, and semi-permanent adhesive 78 of the multiple use type similar to that used in postable notes is applied to lower surfaces 42. In this way, different map, graphs, charts and other planar graphic representations disposed onto a number of graphic portions 40 may be used with a set of base portions 12.

Figure 12:
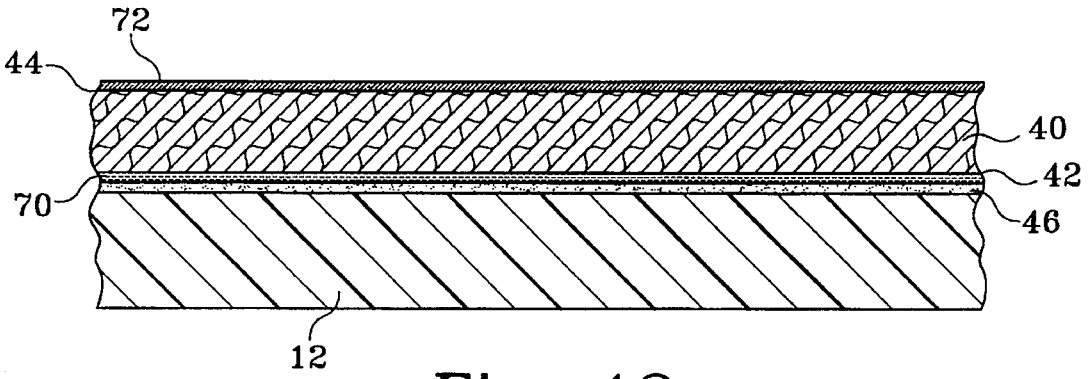
FIG. 12 is a cross-section detail view of a module of a ninth embodiment of a modular display system representing the present invention.

In a ninth embodiment as depicted in FIG. 12, cover portions 50 may be omitted and a transparent impermeable coating such as varnish 72 may be applied to upper surfaces 44, and lower surfaces 42 may be coated with anti-stick coating 70, in order to permit graphic portions 40 to be removably attached to base portions 12. Consequently, a number of different map, graphs, charts and other planar graphic representations disposed onto a number of graphic portions 40 may be used with a set of base portions 12. As previously described, the material from which graphic portions 40 is formed may be treated to resist penetration by anti-stick coating 70 which may tend to permeate into graphic portions 40.

Figure 13:
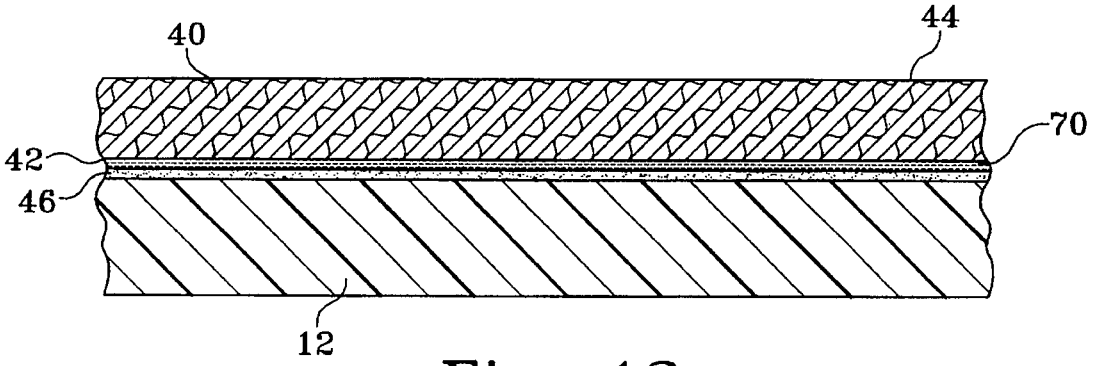
FIG. 13 is a cross-section detail view of a module of a tenth embodiment of a modular display system representing the present invention.

In a tenth embodiment as depicted in FIG. 13, cover portions 50 may be omitted, and lower surfaces 42 may be coated with anti-stick coating 70, in order to permit graphic portions 40 to be removably attached to base portions 12. Different map, graphs, charts and other planar graphic representations disposed onto a number of graphic portions 40 may be used with a set of base portions 12. The material from which graphic portions 40 is formed may be treated at lower surface 42 to resist penetration by anti-stick coating 70 which may tend to permeate into graphic portions 40, and to make upper surfaces 44 may be treated to be impermeable to markers, pens and the like.

The present invention having been described in its preferred embodiments, it is clear that it is susceptible to numerous modifications and embodiments within the ability of those skilled in the art and without the exercise of the inventive faculty. Accordingly, the scope of the present invention is defined by the scope of the following claims.

What is claimed is:

1. A modular display system comprising:

a plurality of identical, generally rectangular planar base portions, each base portion having a top surface, first and second longer sides, and first and second shorter sides, said first longer side and said first shorter side having at least one projecting tongue disposed in the plane of said base portion, and said second longer side and said second shorter side each having at least one corresponding groove, each of said at least one tongue of said first longer side of each of said base portions capable of mating with one of said at least one groove of said second longer side of another of said base portions and each of said at least one tongue of said first shorter side of each of said base portions capable of mating with one of said at least one groove of said second shorter side of another of said base portions, so that said base portions may be disposed to form an interlocking planar array;

a plurality of rectangular planar graphic portions, each graphic portion having a lower surface and an upper surface, with planar dimensions defined by each of said graphic portions substantially the same as rectangular planar dimensions defined by each of said base portions;

means for aligning attachment of each of said graphic portions to one of said base portions so that each of said top surfaces is adjacent to one of said lower surfaces, the tongues of each of said base portions project away from the graphic portion attached thereto in a direction parallel to the plane of the base portion, and each of the graphic portions overlaps and covers the grooves of the base portion attached thereto;

a plurality of identical rectangular transparent cover portions, each cover portion having an inside surface and an outside surface, with planar dimensions defined by each of said cover portions substantially the same as the planar dimensions of each of said graphic portions; and means for aligning attachment of each of said cover portions to one of said graphic portions so that each of said upper surfaces is adjacent to one of said inside surfaces.

2. A modular display system as defined in claim 1, wherein at least one of said tongues of each of said base portions defines a mounting hole.

3. A modular display system as defined in claim 1, further comprising indicia means for indicating relative position of each of said graphics portions with respect to the other said graphic portions.

4. A modular display system as defined in claim 1, wherein said means for aligning attachment of each of said graphic portions to one of said base portions comprises adhesive disposed between said top surfaces and said lower surfaces.

5. A modular display system as defined in claim 1, wherein said means for aligning attachment of each of said graphic portions to one of said base portions comprises means for demountable attachment of each of said graphic portions to one of said base portions including adhesive disposed upon said top surfaces and anti-stick coating upon said lower surfaces.

6. A modular display system as deemed in claim 5, wherein said means for aligning attachment each of said cover portions to one of said graphic portions comprises means for demountable attachment of each said cover portions to one of said graphic portions including adhesive disposed upon said inside surfaces and anti-stick coating disposed upon said upper surfaces.

7. A modular display system as defined in claim 1, wherein said means for aligning attachment of each of said graphic portions to one of said base portions comprises means for demountable attachment of each of said graphic portions to one of said base portions including a semi-permanent adhesive disposed between said top surfaces and said lower surfaces.

8. A modular display system as defined in claim 1, wherein said means for aligning attachment each of said cover portions to one of said graphic portions comprises adhesive disposed between said upper surfaces and said inside surfaces.

9. A modular display system comprising:

a plurality of identical, generally rectangular planar base portions, each base portion having a top surface, first and second longer sides, and first and second shorter sides, said first longer side and said first shorter side having at least one projecting tongue disposed in the plane of said base portion, and said second longer side and said second shorter side each having at least one corresponding groove, each of said at least one tongue of said first longer side of each of said base portions capable of mating with one of said at least one groove of said second longer side of another of said base portions and each of said at least one tongue of said first shorter side of each of said base portions capable of mating with one of said at least one groove of said second shorter side of another of said base portions, so that said base portions may be disposed to form an interlocking planar array;

a plurality of rectangular planar graphic portions, each graphic portion having a lower surface and an upper surface, with planar dimensions defined by each of said graphic portions substantially the same as rectangular planar dimensions defined by each of said base portions;

means for aligning attachment of each of said graphic portions to one of said base portions so that each of said top surfaces is adjacent to one of said lower surfaces, the tongues of each of said base portions project away from the graphic portion attached thereto, and each of the graphic portions overlaps and covers the grooves of the base portion attached thereto; and transparent cover means for coveting each of said upper surfaces.

10. A modular display system as defined in claim 9, wherein at least one of said tongues of each of said base portions defines a mounting hole.

11. A modular display system as defined in claim 9 further comprising indicia means for indicating relative position of each of said graphics portions with respect to the other said graphic portions.

12. A modular display system as defined in claim 9, wherein said means for aligning attachment of each of said graphic portions to one of said base portions comprises means for demountable attachment of each of said graphic portions to one of said base portions including adhesive disposed upon said top surfaces and anti-stick coating disposed upon said lower surfaces.

13. A modular display system as defined in claim 9, wherein said transparent cover means comprises varnish disposed upon said upper surfaces.

14. A modular display system as defined in claim 9, wherein said means for aligning attachment of each of said graphic portions to one of said base portions comprises means for demountable attachment of each of said graphic portions to one of said base portions including a semi-permanent adhesive disposed between said top surfaces and said lower surfaces.

15. A modular display system comprising:

a plurality of identical, generally rectangular planar base portions, each base portion having a top surface, first and second longer sides, and first and second shorter sides, said first longer side and said first shorter side having at least one projecting tongue disposed in the plane of said base portion, at least one of said tongues defining a mounting hole, and said second longer side and said second shorter side each having at least one corresponding groove, each of said at least one tongue of said first longer side of each of said base portions capable of mating with one of said at least one groove of said second longer side of another of said base portions and each of said at least one tongue of said first shorter side of each of said base portions capable of mating with one of said at least one groove of said second shorter side of another of said base portions, so that said base portions may be disposed to form an interlocking planar array;

a plurality of rectangular planar graphic portions, each graphic portion having a lower surface and an upper surface, with planar dimensions defined by each of said graphic portions substantially the same as rectangular planar dimensions defined by each of said base portions;

adhesive disposed between said top surfaces and said lower surfaces for aligning attachment of each of said graphic portions to one of said base portions so that said top surfaces are adjacent to said lower surfaces, the tongues of each of said base portions project away from the graphic portion attached thereto in a direction parallel to the plane of the base portion, and each of the graphic portions overlaps and covers the grooves of the base portion attached thereto;

a plurality of identical rectangular transparent cover portions, each cover portion having an inside surface and an outside surface, with planar dimensions defined by each of said cover portions substantially the same as the planar dimensions of each of said graphic portions;

adhesive disposed between said upper surfaces and said inside surfaces for aligning attachment each of said cover portions to one of said graphic portions so that said upper surfaces am adjacent to said inside surfaces; and indicia means for indicating relative position of each of said graphics portions with respect to the other graphic portions.

* * * * *